United States Patent [19]

Kruger et al.

[11] Patent Number: 4,681,385

[45] Date of Patent: Jul. 21, 1987

[54] ELECTRICAL CONNECTOR SYSTEM

[75] Inventors: Kurt J. Kruger, Huntington; Lester Miller, Danbury, both of Conn.

[73] Assignee: Dart Industries Inc., Northbrook, Ill.

[21] Appl. No.: 851,408

[22] Filed: Apr. 11, 1986

[51] Int. Cl.[4] ..... H01R 4/48

[52] U.S. Cl. ..... 439/252; 439/21; 439/568; 439/186; 439/686; 439/692; 439/842

[58] Field of Search ..... 339/8 R, 8 P, 58, 111, 339/41, 64 R, 64 M, 191 A, 191 S, 192 RL, 195 A, 195 S, 48, 49 B, 256 RT, 256 S

[56] References Cited

U.S. PATENT DOCUMENTS

| | | | |
|---|---|---|---|
| 359,982 | 3/1887 | Plume | 339/49 B |
| 693,087 | 2/1902 | Uytenbogaart | 339/176 L |
| 737,227 | 8/1903 | Hadaway, Jr. | 219/247 |
| 803,246 | 10/1905 | Parnell | 339/176 L |
| 891,263 | 6/1908 | Klein | 174/67 |
| 905,459 | 12/1908 | Rice, Jr. | 219/247 |
| 932,139 | 8/1909 | Kempton | 339/176 B |
| 943,016 | 12/1909 | Guett | 339/40 |
| 1,199,172 | 9/1916 | Garrison | 339/8 P |
| 1,222,721 | 4/1917 | Bissell et al. | 339/64 R |
| 1,606,832 | 11/1926 | Forshee | 339/8 P |
| 2,234,347 | 3/1941 | Lobstein | 219/25 |
| 2,528,014 | 10/1950 | Moses, Jr. et al. | 173/330 |
| 2,637,765 | 5/1953 | Zalduondo | 339/8 P |
| 2,766,434 | 10/1956 | Gear | 339/8 R |
| 3,056,940 | 10/1962 | Winestock | 339/64 R |
| 3,398,260 | 8/1968 | Martens | 219/247 |
| 3,760,149 | 9/1973 | Harsanyi | 219/247 |
| 3,813,638 | 5/1974 | Kinnear | 339/64 R |
| 4,168,104 | 9/1979 | Buschow | 339/40 |
| 4,528,429 | 7/1985 | Dobson et al. | 339/40 |

FOREIGN PATENT DOCUMENTS

| | | | |
|---|---|---|---|
| 1320114 | 1/1963 | France | 339/8 P |

*Primary Examiner*—John McQuade
*Attorney, Agent, or Firm*—Gregory J. Mancuso

[57] ABSTRACT

An electrical connector system comprising a cylindrical plug assembly with terminals and a cylindrical socket assembly with terminals is disclosed. The assemblies may be axially joined virtually independent of their rotational orientation with respect to each other to effect the proper coupling of the terminals. The terminals of each assembly are recessed within their assemblies and coil springs are positioned to bias the terminals into an electrical coupling relationship with one other.

20 Claims, 20 Drawing Figures

ELECTRICAL CONNECTOR SYSTEM

BACKGROUND OF THE INVENTION

1. Field of the Invention

This invention relates to electrical connectors and, more particularly, to electrical connector systems having plug assemblies and socket assemblies configured so that they may be axially joined, virtually independent of their respective rotational orientations, such that their electrical terminals are recessed and spring biased into contact, one to another.

2. Description of the Prior Art

Electrical connector systems, including those of the type of the present invention, are intended to provide electrical contact between a device and a power supply. For illustrative and descriptive purposes only, the connector systems hereof will be described with the device being an appliance such as a cordless electric iron. Electrical connector systems of a cordless electric iron will allow the simple connection and disconnection of the iron with respect to a power supply, preferably while permitting the iron to be placed on the power supply in virtually any rotational orientation.

Various connectors have been designed whereby power may be applied to a cordless electric iron. The advantages of such electrical connectors in cordless electric irons are well known. Such connectors permit the iron to be utilized without an attached cord and yet permit the coupling of electric power to the iron for generating heat whenever the iron is placed in association with the source of electrical power in the socket.

Further, the user need not be concerned with the length and positioning of the electrical cord during ironing. Additionally, the danger of accidentally tripping over the cord is reduced considerably since the cord connection between the source of electrical power in the socket and a wall outlet can be readily positioned in such a way that the cord is out of the way.

Prior art cordless electric irons furnish a base or support which is provided with electrical terminals which may contact complementary terminals in the iron where the iron is placed on the base. In most instances, the terminals of the base and the iron can present problems in that the iron must be placed on the base in a predetermined orientation if the electrical connection is to be properly made. Unneccessary skill is thus required of the operator. Further, problems can arise if the electrical contacts of either the base or the iron are unnecessarily exposed and accidentally contact a foreign element such as a nail, hair pin, or the like, since a short circuit could arise electrocuting a user or causing fire damage. Additionally, exposed or nonrecessed electrical terminals are subject to being deformed by contact with extraneous members which could preclude proper functioning. Yet an additional problem with prior art devices can arise since the electrical terminals can be deformed through time whereby proper electrical contact therebetween does not occur when the iron is placed on the base.

Various structures are described in the prior patent publications which are directed to features which may improve the safety, convenience or operation of cordless electric irons or other electrical devices or appliances employing electrical connectors between the iron and its base. By way of example, U.S. Pat. Nos. 891,263 to Klein; 943,016 to Guett; 2,528,014 to Moses; and 4,168,104 to Buschow describe recepticals whereby inadvertent contact of an extraneous element with the hot electrical terminals is precluded by shielding mechanisms at the socket. The shielding mechanisms are moved out of their protective positions to allow the terminals of the plug to couple with the electrical terminals of the socket only upon a predetermined movement of the plug. This requires a particular aligning skill by the person attempting to make the electrical contact.

Various electrical connectors have also been designed for specific utilization in association with devices or appliances such as cordless electric irons. Examples of such connectors are found in U.S. Pat. Nos. 2,234,347 to Lobstein; 3,760,149 to Harsanyi and 3,398,260 to Martens. The structures of each of these patented devices advanced the state of the art at the time such inventions were made, but each included a shortcoming which is overcome by the present invention.

According to the Lobstein invention, an electrical terminal was exposed on the handle of the iron and could only be coupled with the source of electrical power when oriented in a predetermined position on the base. Consequently, unnecessary attention to such positioning was required by an operator for proper utilization. The same problems were true in the device described in the Harsanyi patent. Moreover, additional care had to be taken in Harsanyi so that not only were the electrical contacts properly aligned but also so that the magnet, or the like, was properly aligned whereby electrical power could be provided to the base.

The device disclosed by Martens permitted a cordless electric iron to be positioned in any orientation on a base. However, the electrical contacts were not shielded. As a result, the terminals of the plug as well as the base could be contacted by an extraneous member causing potential danger to a user or a bystander. Such terminals were also subject to being contacted and damaged by foreign material which might inadvertently deform such contacts and, through time, be detrimental to proper contact being made between the plug and socket. Note, for example, the plug contacts of Martens extend outwardly a distance merely substantially equal to a surrounding cylindrical shield whereby contact with a button, seam, zipper or the like could deform one or both of the relatively expensive cylindrical terminals Such deformation of the terminals as may occur through misuse or even through the passage of time could readily preclude proper contact between the contacts since there was no provision for the spring biasing of the terminals one to another.

As illustrated by the great number of patent disclosures, efforts are continuously being made in an attempt to solve the problem of designing a universal, safe, convenient, electrical connector system having particular utility in appliances such as cordless electric irons. None of these patents, however, discloses or suggests the present inventive combination of an electrical connector with plug and socket which may be joined virtually independent of the rotational orientation of one with respect to the other while recessing and biasing the electrical terminals for extended utility, convenience and safety. The present invention achieves its purposes, objectives and advantages over the prior art through new, useful and unobvious elements, with a minimum number of functioning parts, at a reduction of cost and through the utilization of only readily available materials and conventional components.

These objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary of the invention and detailed description describing the preferred embodiments of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. For the purposes of summarizing the invention, the invention may be incorporated into apparatus such as an electrical connector system comprising a cylinrical plug assembly having electrical plug terminal means spaced a predetermined distance from the axis of the plug assembly and a cylindrical socket assembly having electrical socket terminal means spaced a predetermined distance from the axis of the socket assembly. The plug terminal means and the socket terminal means are engagable one with respect to the other to form an electrical connection therebetween when the plug assembly and the socket assembly are joined in axially alignment, virtually independent of the rotational position therebetween. Biasing means are provided to urge the plug terminal means and the socket terminal means towards each other to insure a secure electrical contact therebetween when the assemblies are joined. The socket terminal means are recessed within the socket assembly and the plug terminal means are recessed within the plug assembly with the distance of recess for the plug terminal means being greater than the distance of recess for the socket terminal means. The plug terminal means are separated by insulating means and the socket terminal means are separated by insulating means. The plug assembly includes radially inwardly projecting protuberances in a predetermined orientation with respect to the plug terminal means and the socket assembly includes radially outwardly projecting vanes in a predetermined orientation with respect to the socket terminal means so as to preclude the joining of the assemblies in an inoperative orientation. The biasing means includes a coil spring positioned to resiliently urge one of the terminal means toward the other of the terminal means. The coil spring may be positioned within the plug assembly with its axis on the axis of the plug assembly. This coil spring has its opposite free ends secured to elements of the plug assembly whereby torsional forces of the coil spring will resiliently urge the plug terminal means toward the socket terminal means. The coil spring may also be positioned within the socket assembly with its axis formed in a circle and with the center of the circle located on the axis of the socket assembly. This coil spring has its exterior surface positioned adjacent the socket terminal means whereby forces of the coil spring will resiliently urge the plug terminal means toward the socket terminal means.

In the first embodiment of the invention, the electrical connector system comprises a cylindrical plug assembly and a cylindrical socket assembly with the plug assembly including a cylindrical side wall and a circular upper plate, an electrically insulating cylindrical plug block rotatably depending from the center of the plate; a pair of electrically conductive prongs secured to the plug block and depending therefrom for rotation therewith; a coil spring having its axis aligned with the axis of the side wall, plate and plug block, the coil spring having its one end secured to the plate and its other end secured to the plug block to thereby tend to rotate the plug block and prongs in a first rotational direction; and tubular means extending downwardly from the plug block. The socket assembly includes a base plate with an upstanding cylindrical side wall and a circular cover face having a circular aperture therein; an electrically insulating cylindrical socket block axially slidable and rotatable between the base plate and the cover face; a pair of electrically conductive prongs secured to the socket block in upstanding relationship for sliding and rotation therewith; a coil spring having its axis aligned with the axis of the socket block, side wall and cover face for urging the socket block away from the base plate; and rotation imparting means to rotate the socket block in a second rotational direction, opposite from the first rotational direction, upon axial movement of the socket block whereby upon the axial joining of the plug assembly with the socket assembly the tubular means will depress the socket block and rotate it to thereby rotate the prongs on the plug block into contact with the prongs on the socket block. The motion imparting means include a rigid helical strip upstanding from the base coiled about its axis and a slot in the socket block for receiving the strip whereby axial movement of the socket block along its axis and the axis of the strip will rotate the socket block. The cover face is formed with bevels at its upper exterior edge to facilitate the joining of the plug assembly with the socket assembly in axial alignment. Further included are radially inwardly projecting protuberances on the side wall of the plug assembly in radial alignment with the prongs of the plug block and radially outwardly projecting vanes on the side wall of the socket assembly in radial alignment with the prongs of the socket block so as to preclude the joining of the assemblies with the plug prongs aligned with the socket prongs. Further included are an abutment pin depending from the upper plate and an abutment arm extending radially from the plug block whereby contact between the abutment pin and the abutment arm will limit the rotational movement of the plug block in the first rotational direction. The plug prongs are recessed within the plug assembly a distance greater than the distance the socket prongs are recessed within the socket assembly.

In the second embodiment of the invention, the electrical connector system comprises a cylindrical plug assembly and a cylindrical socket assembly. The plug assembly includes a cylindrical side wall with a circular upper face; a pair of electrically conductive prongs secured to the upper face in depending relationship therewith; and a cylindrical post depending from the center of the upper face. The socket assembly includes a base plate with an upstanding cylindrical exterior side wall and an upstanding cylindrical interior side wall, the side walls being concentric about an axis common with the socket assembly and defining an annular aperture therebetween; a pair of electrically conductive strips secured to the interior side wall and extending into the annular aperture; and coil spring means secured to the exterior side wall with its axis in a circle and with the center of the circle on the axis of the common axis and with an exterior surface adjacent the conductive strips whereby, when the plug assembly is axially joined with the socket assembly, the plug prongs will be spring biased toward the conductive strips. Further included are two insulating vanes extending radially through the exterior side wall to divide the conductive strips and the spring means each into two electrically separate segments essentially of semicircular configuration. Further included are two protuberences extending inwardly from the side wall of the plug assembly and radially aligned with the plug prongs, the protuberences and the vanes being oriented to preclude the plug prongs from spanning the two segments of the conductive strips. The conductive strips are bowed radially outwardly with their centerlines extending into the annular opening. The upper surfaces of the cylindrical side walls are each formed with bevels to facilitate the joining of the plug assembly with the socket assembly in axial alignment.

The foregoing has outlined rather broadly the more pertinent and important features of the present invention in order that the detailed description of the invention that follows may be better understood whereby the present contribution to the art can be more fully appreciated. Additional features of the invention will be described hereinafter which form the subject of the claims of the present invention. It should be appreciated by those skilled in the art that the conception and the specific embodiments disclosed herein may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which.

Similar reference numerals refer to similar parts throughout the several drawings.

DETAILED DESCRIPTION OF THE INVENTION

Figure 1:
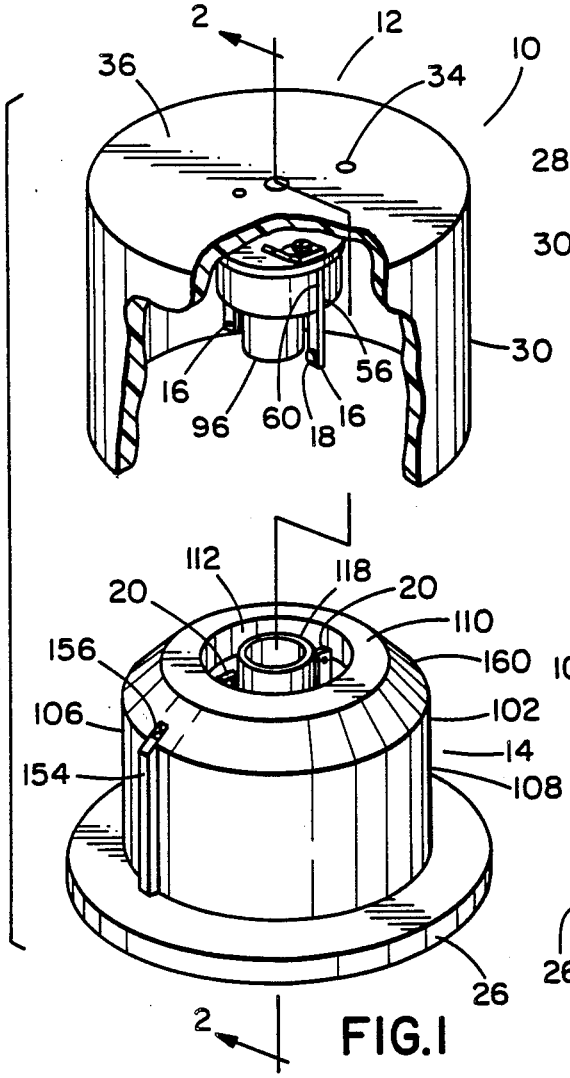
FIG. 1 is a front perspective illustration of one embodiment of the electrical connector system constructed in accordance with the principals of the present invention, with the plug assembly and socket assembly separated and with parts broken away to show certain internal constructions.

Shown in the various drawings are two embodiments of the connector system constructed in accordance with the principles of the present invention. The first embodiment, that shown in FIGS. 1 through 12, includes a connector system 10 having a plug assembly 12 and a socket assembly 14. The plug assembly includes first electrically conductive prongs 16 with terminals 18 adapted to be coupled electrically through wires or leads as to a device or applicance such as a cordless electric iron which it is adapted to be powered or heated for proper use. The socket assembly 14, similarly, has a pair of second electrically conductive prongs 20 with terminals 22 adapted to be electrically coupled as through wires to a wall outlet or other suitable source of electrical power. The socket assembly includes a base 26 which may be positioned as on an ironing board when, for descriptive and illustrative purposes only, the application for the connector system is a cordless electric iron which will be used herein as the electrical device or appliance. It should be understood, however, that the inventive electrical connector system of this invention could readily be used in a wide variety of devices or appliances.

As used herein the terms "up" and "down" and "upward" and "downward," etc. are used for illustrative purposes only since such language describes the normal positioning of an electrical connector system in a cordless electric iron. It should be understood, however, that the present invention may be utilized to electrically couple devices in orientations other than those which are vertically aligned. Such terms as quoted above are not intended to limit the invention as described and claimed herein.

Disclosed herein are socket assemblies only. Descriptions of cordless electric irons with electrical connector systems can be found in U.S. patent application Ser. No. 583,631, filed Mar. 2, 1984, now U.S. Pat. No. 4,528,429, entitled Electrical Connector and U.S. patent application Ser. No. 750,958, filed July 2, 1985, entitled Cordless Iron, both of which are assigned to the assignee of the present application. Such cordless electric irons and coupling between such irons and plugs and between such sockets and wall outlets could be used in association with the electrical connector systems of the present invention. Furthermore, the disclosure of such prior applications is incorporated by reference herein.

The plug assembly of the first embodiment of the present invention includes an electrically insulating, inverted cup-like housing 28 having a downwardly extending side wall 30 in a cylindrical configuration and circular upper plate 32. The upper plate is provided with an aperture 34 so as to permit electrical wires to couple the prongs 16 to the device being powered. The external or upper surface 36 of the upper plate 32 may be adhered, bolted or otherwise attached to the cordless electric iron or other device being powered. An insulating cylindrical plug block 40 is rotatably attached to the upper plate 32 for rotation about its axis which is common with the axis of the side wall 30 and plate 32 of the cylindrical housing. A threaded aperture 42 is provided centrally through the upper plate 32 at its center so that a bolt 44 may pass therethrough for attachment to the threaded aperture 42 at the center of the upper plate 32. The plug block 40 has a central bore 46 with a ledge 48 for accommodating the head 50 of the bolt 44. The bolt, in turn, has a step 52 for proper locating of the elements with respect to the plate 32. Also, a washer 54 is provided between the plate 32 and block 40 to allow proper spacing and sliding therebetween.

The plug block is provided with opposed radial slots 56 at its periphery for the securement of elongated central portions 60 of the prongs. The prongs are then bent to horizontal sections 62 circumferentially positioned upon the upper surface 64 of a ledge 66 on the plug block. Bolts 68 secure the prongs in proper orientation with their terminals extending downwardly and with their ears 70 extending upwardly for securement to wires extendable into the iron being powered.

The plug block also includes an upwardly extending cylindrical portion 74 adapted to be surrounded, as is the washer, by a plug block coil spring 76. The upper free end 78 of this coil spring is fixedly positioned in a small aperture 80 in the upper plate. The lower free end 82 of this coil spring is fixedly positioned in a small aperture 84 in the ledge of the plug block. The spring is wound so that the block tends to move clockwise when viewed in FIG. 1, counterclockwise when viewed in FIG. 4, upon the release of preapplied pressure during operation and use.

In order to limit the extent of rotary motion of the plug block, a downwardly extending abutment pin 86 is threaded into an aperture 88 in the upper plate of the housing. The pin is adapted to be contacted by an abutment arm 90 radially extended from an abutment plate secured as by bolts 92 to the upper surface of the ledge. Lastly, a downwardly extending hollow tube 96 depends from the main portion of the plug block. Its lower surface 98 constitutes a bearing surface for a purpose to be later described.

The socket assembly 14 is formed of a housing 102 having a planar base 26, the lower surface 104 of which is adapted to be positioned on a reference surface such as an ironing board. The remainder of the housing includes an inverted cup-shaped member 106 having an upstanding cylindrical side wall 108 and an upper cover face 110 formed with an enlarged circular aperture 112 therein. Located adjacent to aperture 112 is a cylindrical socket block 116 from which the prongs 20 extend into aperture 112. Circumferentially bent horizontal sections 120 are secured through bolts 122 to the block 116 at its lower face 124 and include downwardly depending ears 126 for joining with electrical wires for coupling to a wall outlet or other source of electrical potential through an aperture in the base. The upper portion of socket block 116 comprises a cylindrical wall 118 which projects into aperture 112 and forms a recess 144 having a bottom bearing surface 119.

The exterior diameter of the socket block 116 is slightly greater than that of the aperture 112 thereabove to preclude its movement out of the housing. It is biased into position by a socket coil spring 128. The lower portion of the coil spring is secured around an upstanding post 130 extending from the base plate. The upper portion of the spring is received in a dished out central portion 132 on the lower surface of the block for insuring proper positioning of the spring 128 during operation and use. Also located within the post is a slot 134 for fixedly receiving a rigid spiral strip 138, as of sheet metal, the upper end 140 of which is slidably received in a slot 142 in the socket block. The axis of the spiral is common with the axis of the base, post, spring and socket block as well as the axis of the elements of the plug assembly as described above.

Figure 2:
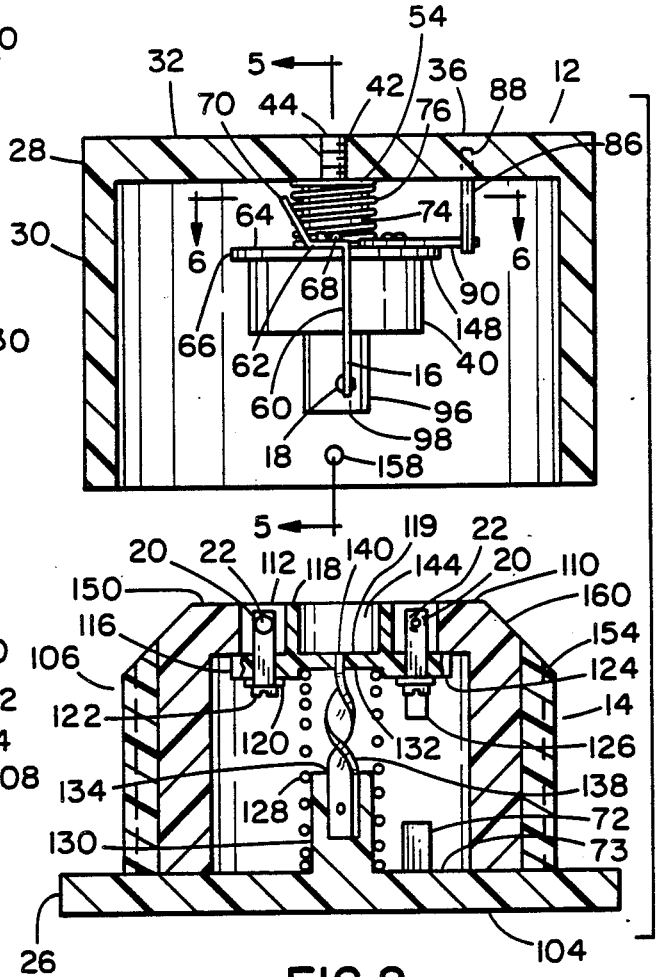
FIG. 2 is a front elevational view of the connector system shown in FIG. 1 but with the side walls and other elements taken in a cross-sectional view through planes 2—2 of FIG. 1.
Figure 3:
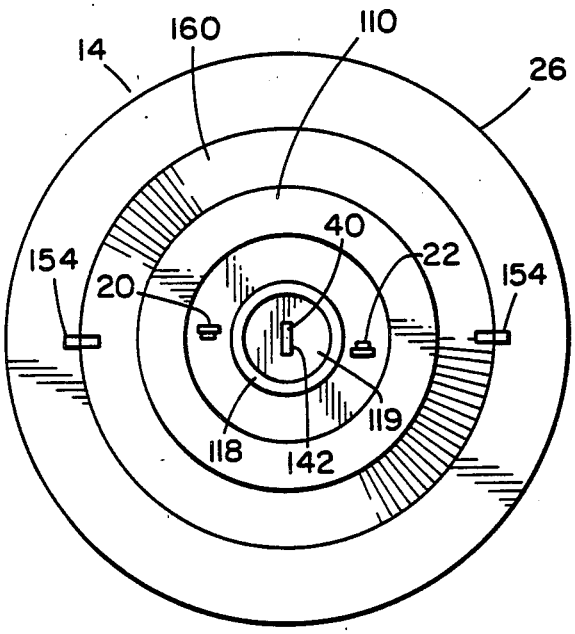
FIG. 3 is a top plan view of the socket assembly shown in FIGS. 1 and 2.
Figure 4:
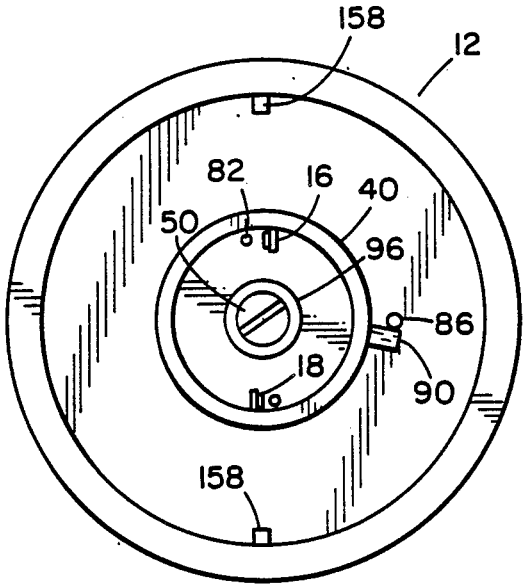
FIG. 4 is a bottom plan view of the plug assembly shown in FIGS. 1 and 2 looking upwardly thereat.
Figure 5:
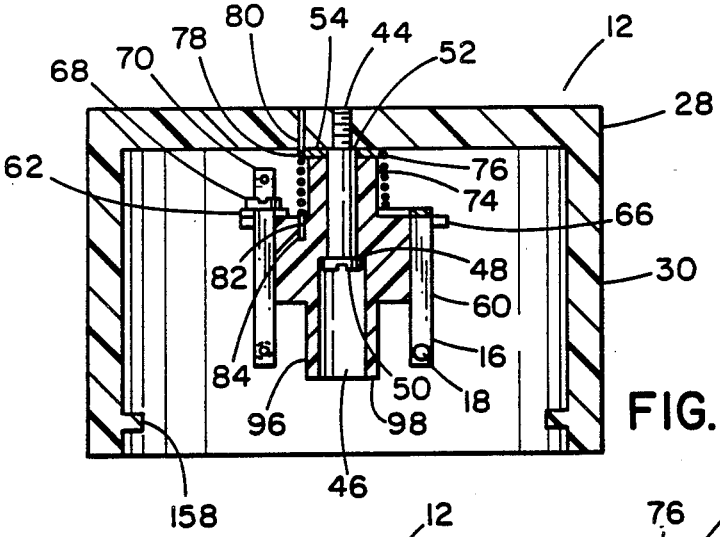
FIG. 5 is a sectional view of the plug assembly shown in FIGS. 1 and 2 taken along plane 5—5, shown in FIG. 2.
Figure 6:
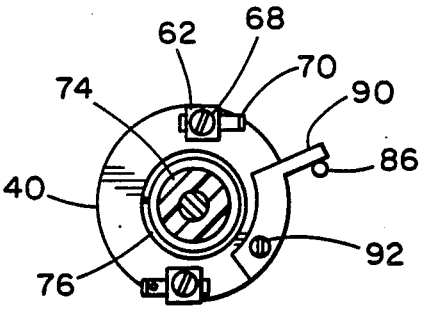
FIG. 6 is a sectional view of the plug assembly taken along plane 6—6 of FIG. 2.

The arrangement of elements of the plug assembly is such that upon the application of a downward force onto the socket block, the socket block will move downwardly against the force of the spring and cause the socket block to spiral clockwise as shown in FIGS. 1 and 2 along the spiral strip 138 while compressing the coil spring. Upon the relief of such downward force, the coil spring will return the socket block to its position as shown in FIGS. 1 and 2 while counter rotating it.

Figure 7:
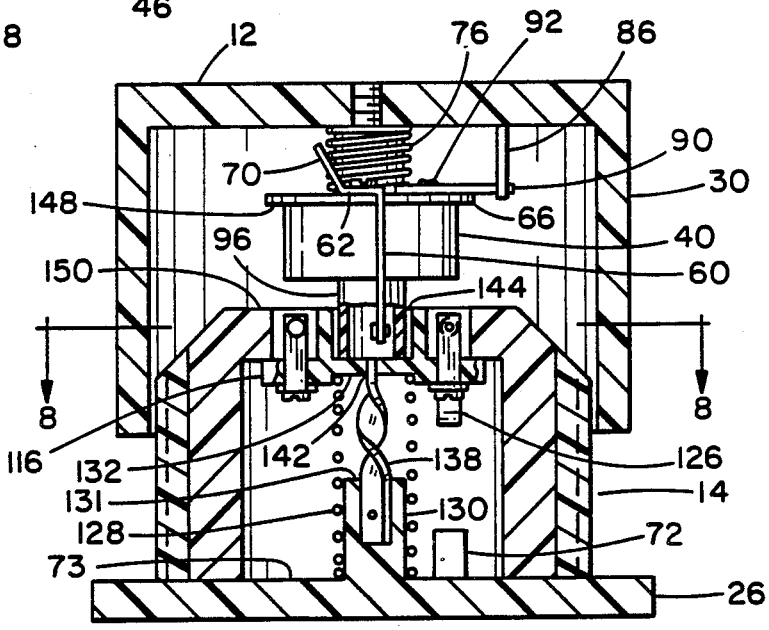
FIG. 7 is a side elevational view similar to that shown in FIG. 2 but with the plug and socket assemblies moved partially toward operative relationship one with respect to the other and with additional parts broken away to show additional internal constructions.
Figure 8:
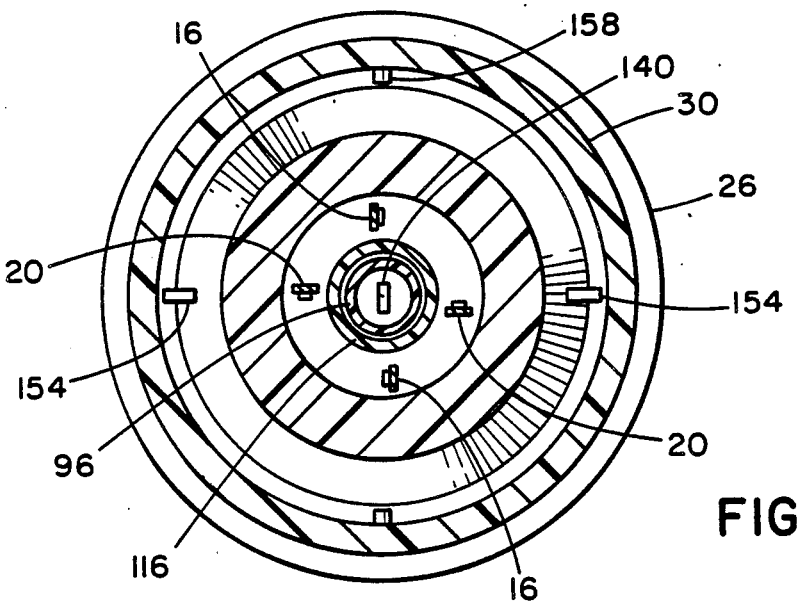
FIG. 8 is a sectional view of the system taken along plane 8—8 of FIG. 7.
Figure 9:
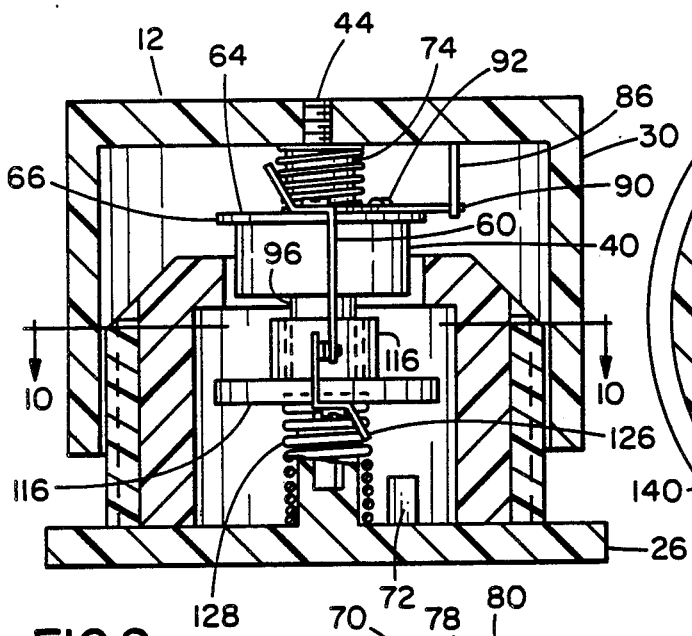
FIG. 9 is a side elevational view similar to FIGS. 2 and 7 but with the plug and socket assemblies joined sufficiently to couple their electrical terminals.
Figure 10:
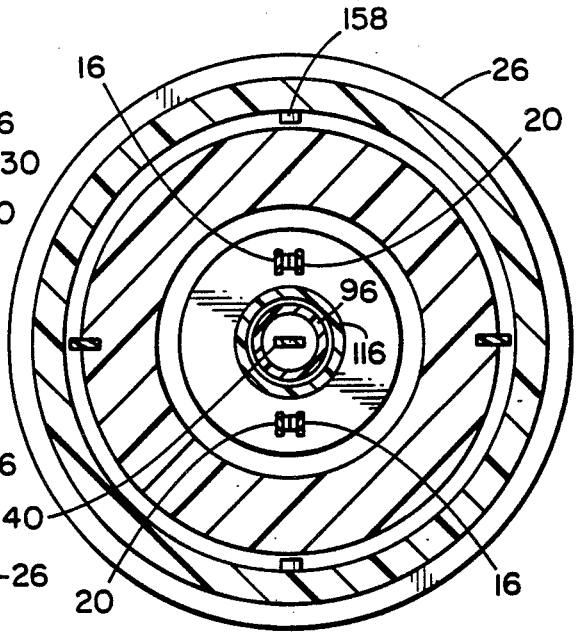
FIG. 10 is a sectional view of the system taken along plane 10—10 of FIG. 9.
Figure 11:
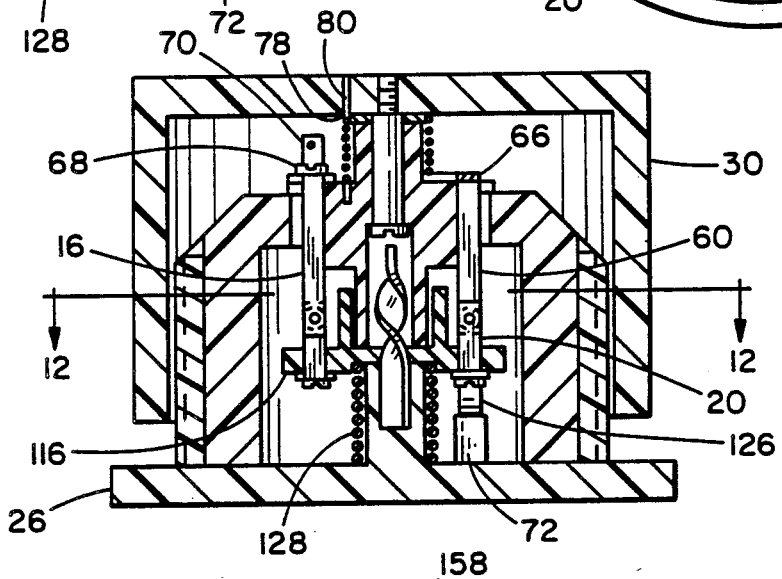
FIG. 11 is a sectional view of the connector system as shown in FIG. 9 but with the plug and socket assemblies fully joined.
Figure 12:
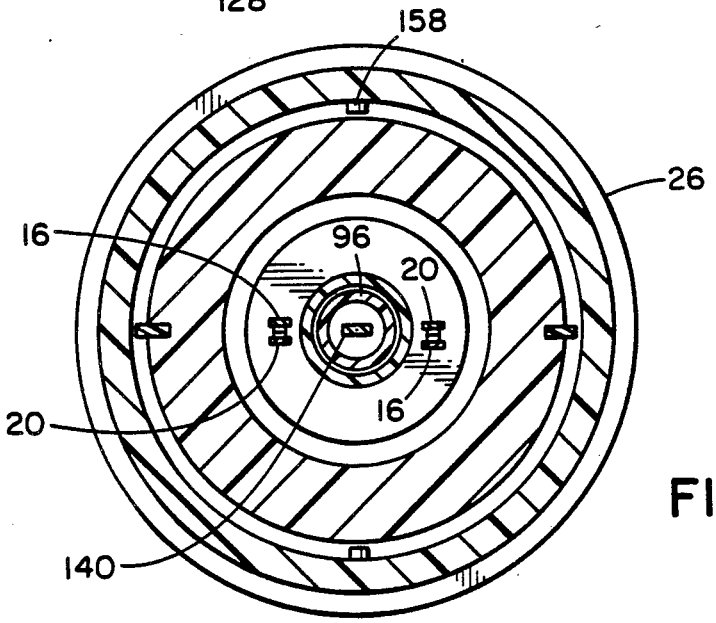
FIG. 12 is a sectional view of the system taken along plane 12—12 of FIG. 11.
Figure 13:
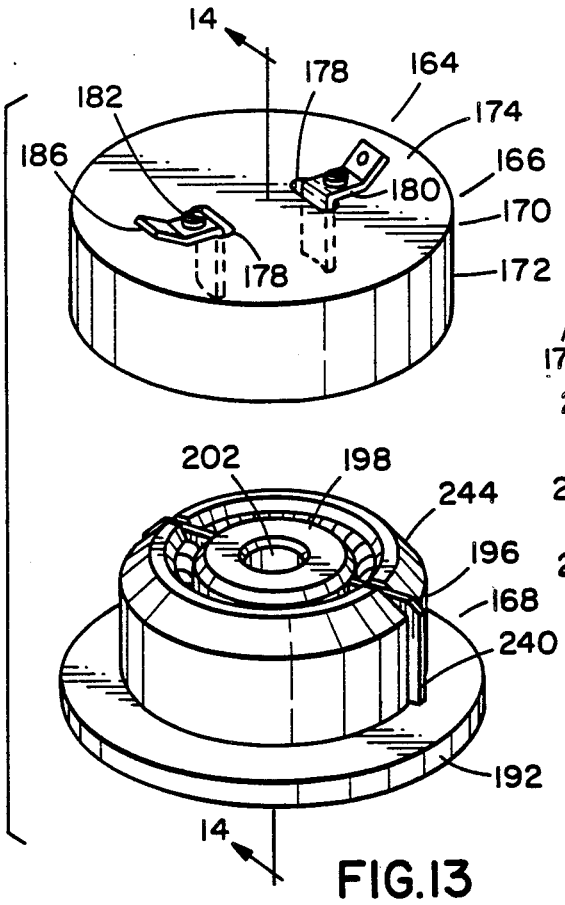
FIG. 13 is a front perspective illustration of a second embodiment of the electrical connector system constructed in accordance with the principles of the present invention with the plug and socket assemblies separated.
Figure 14:
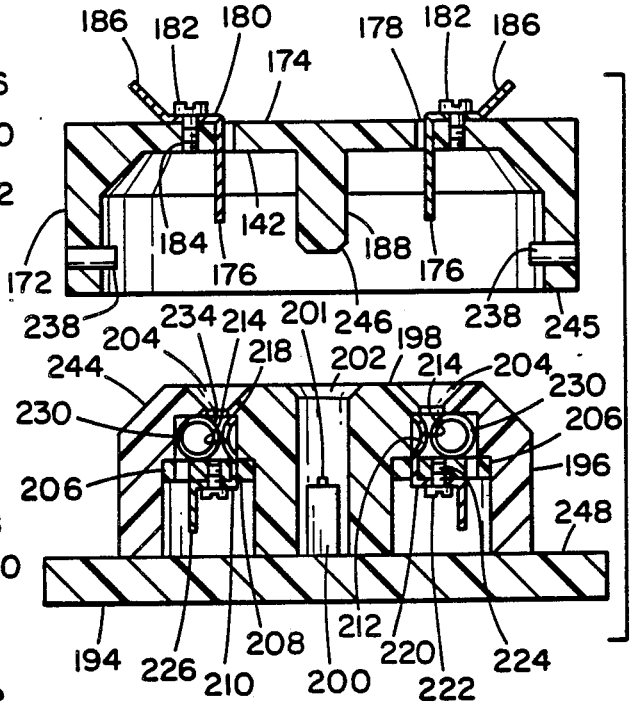
FIG. 14 is a sectional view of the electrical connector system of the second embodiment taken along plane 14—14 of FIG. 13.
Figure 15:
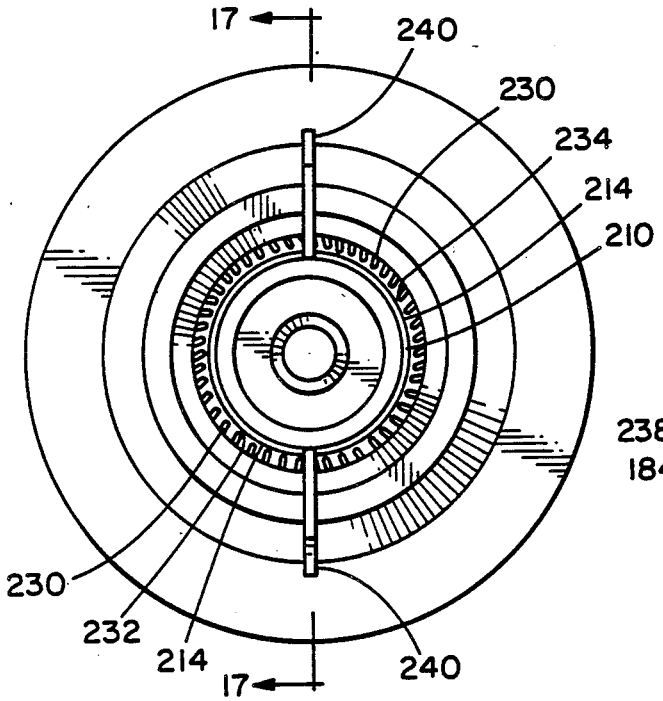
FIG. 15 is a top plan view of the socket assembly shown in FIGS. 13 and 14.

In operation and use, the plug assembly is axially placed upon the socket assembly with its downwardly extending hollow tube 96 located within upwardly extending recess 144 in the socket block, as shown in Fig. 7. Lower surface 98 of hollow tube 96 bears on bearing surface 119 of socket block 116. The weight of the plug assembly, coupled with that of the appliance to which it is secured, will cause the socket block to move downwardly. The interaction of the socket block 116 and spiral strip 138 will impart rotational movement to the socket block 116, rotating the it with its upwardly extending prongs until they engage the downwardly extending prongs of the plug assembly, as shown in FIG. 9. The continued downward movement and rotation of the socket block will cause the prongs of the plug assembly to rotate with the rotation of prongs of the socket assembly against the action of the plug coil spring 76 until the lower surface 148 of the ledge engages the upper surface 150 of the face 110, or until central portion 132 engages upper surface 131 of post 130, as shown in FIG. 11. Good electrical contact is made between the terminals of the two assemblies because the spring 76 biases the plug prongs against the socket prongs. Power is supplied and will continue to be supplied to the iron until the iron and its plug assembly are removed from the socket assembly and the coil spring returns the socket block to its rest orientation as shown in FIGS. 1 and 2. Upon such return, the coil spring of the plug assembly will also rotate the plug block clockwise as shown in FIG. 1 and 2 until the abutment arm engages the abutment pin.

As can be seen in the drawings, the electrical terminals of the two assemblies are located at predetermined distances from the axis of the assemblies which support them. This is to insure proper contact therebetween when the assemblies are axially joined and during the making and sustaining of the electrical contact between the terminals of the assemblies. The plug terminals 18 and the socket terminals 22 are located such that when the plug assembly is placed on the socket assembly and tube 96 engages surface 119, the four terminals lie in a common plane.

Vertical vanes 154 are located in slots 156 of the socket assembly radially aligned with the upstanding prongs of the socket assembly. These are in the same orientation as protuberances 158 extending internally and radially of the side wall of the plug housing. The protuberances are aligned with the prongs of the plug assembly. The protuberances and vanes preclude the plug from being placed on the socket with the contacts vertically aligned, an inoperative position which might tend to bend one or more of the prongs. Except for this limitation, the plug assembly may be placed on the socket assembly in virtually any other rotational orientation with proper electrical contact occurring so long as the two assemblies of the system are axially aligned.

A bevel 160 is provided at the upper exterior edge of the cylindrical side wall at the cover face. This is to assist an operator in placing the iron with its plug assembly on the socket assembly in proper axial alignment to effect the proper electrical coupling of the terminals.

As can be seen in the drawings, the prongs of the socket assembly extend with their terminals at a distance to still be within the confines of the socket assembly and thereby minimize their inadvertent contact by a user either directly or through an extraneous object. Further, like the prongs of the plug assembly, the prongs of the socket assembly are separated by a cylindrical insulating portion of the block to preclude inadvertent contact through a straight metal object which might otherwise cause a short circuit causing fire, electrocution or other adverse consequence. Similarly, the prongs of the plug assembly are within the confines of their housing. They are recessed a distance greater than the recess of the socket prongs guaranteeing extra shielding and protection for the plug prongs from upstanding articles as on an ironing board in the event that the plug is placed on a surface other than the socket. As can be understood, this relationship will act to shield the prongs from inadvertent contact by extraneous members since contact between the terminals will not be made until the plug assembly wall surrounds the socket assembly wall. Note FIG. 7.

As can be understood, the action of the various springs functions to provide a spring biasing force on one set of prongs and their terminals with respect to the other set throughout the making and sustaining of electrical contact during operation and use of the electrical connector system.

It can also be seen that the socket can be constructed so that the socket terminals are not connected to a power supply until the plug assembly wall shields the prongs and the plug terminals are engaged with the socket terminals. For example, socket prongs 20 can be connected to a power supply through a switch which is activated when plug assembly 12 is fully engaged with socket assembly 14, and socket block 116 is in its lowermost position. In one embodiment, socket contact 72 is affixed to the internal wall 73 of the socket assembly. Socket contact 72 may comprise a metal spring contact, and is connected to a power supply. When the plug assembly fully engages the socket assembly and the socket block is pushed to its lowermost position, ears 126 engages contact 72 to provide electrical power to the socket prongs. Alternatively, a pair of contacts 72 may be provided, each engaging one of ears 126 when the socket block is in its lowermost position. Socket contact 72 prevents power from being provided to the socket prongs until the plug housing or plug block shields the socket contacts, minimizing a shock hazard and eliminating sparking at the prongs as they engage and disengage.

Shown in FIGS. 13–20 is the second embodiment of the present invention. This connector system 164 includes a plug assembly 166 and a socket assembly 168. The plug assembly is provided with a housing 170 having a circumferential downwardly extending side wall 172 and an upper circular face 174. Downwardly extending prongs 176 are located within oval apertures 178 of the upper face. They have radially extending horizontal surfaces 180 attached as by bolts 182 to threaded aperatures 184 in the upper surface of circular face 174 of the housing. Upwardly extending ears 186 on the prongs are adapted to be coupled as through electrical wires to the device being powered such as the heating element of a cordless electric iron. A cylindrical post 188 depends from the center of the face.

The socket assembly 168 is formed of a base plate 192, the lower surface 194 of which may be supported as on a ironing board surface or the like. Extending upwardly therefrom is an insulating exterior cylindrical wall 196 and an insulating interior cylindrical wall 198 defining a common central bore 202 axially aligned with the remainder of the socket assembly and the axis of the plug assembly. An annular aperture 204 is defined between the walls. A washer 206, formed of an insulating material, is secured within the socket assembly and is provided with apertures 208 for the receipt of upwardly extending conductive strips or terminals 210 having their upper extents 212 expanded into semicircular electrical conductive terminals 210. The upper or terminal portions of the conductors are bowed radially outwardly with their center lines 214 extending horizontally into the aperture 204 provided by the interior and exterior cylindrical walls. The upper edges of the strip terminals 210 are supported within a ledge 218 outwardly extending radially near the top of the interior wall. The lower edges of the strips are supported on the washer 206. A horizontal section 220 of the conductor is attached through bolts 222 to the lower surface of the washer through threaded apertures 224, and downwardly extending ears 226 are provided for the attachment of wires for coupling the conductors to a wall outlet or other source of electrical power.

Also located above the washer, but in contact with the exterior cylindrical member, are two semicircular coil springs 230 with exterior surfaces 234 positioned adjacent the terminals and adapted to resiliently spring bias the prongs of the plug assembly into contact with the strip terminals of the socket assembly during operation and use. The two springs and the two terminals of the socket assembly each extend to nearly 180 degree extents of the socket assembly, in semicircular configuration, whereby the prongs of the plug may be positioned in virtually any rotational orientation with respect to the socket.

Figure 16:
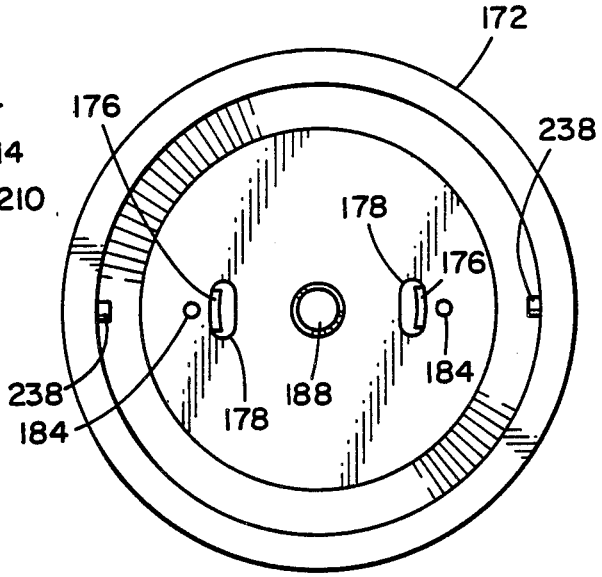
FIG. 16 is a bottom plan view of the plug assembly shown in FIGS. 13 and 14, viewed from the bottom.
Figure 17:
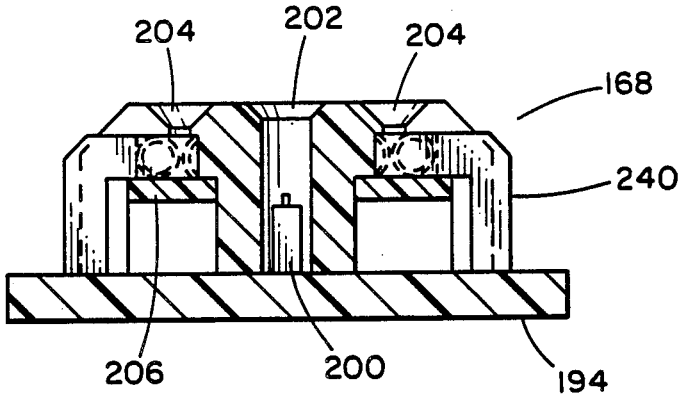
FIG. 17 is a sectional view of the socket assembly taken along plane 17—17 of FIG. 15.
Figure 19:
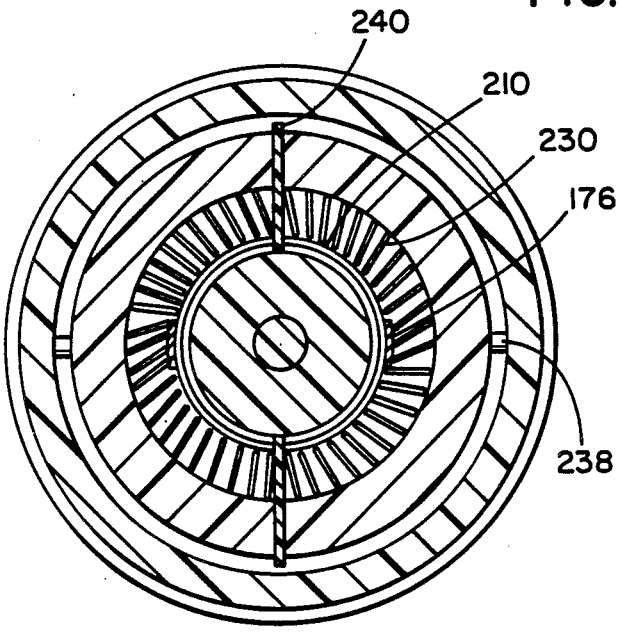
FIG. 19 is a sectional view of the system taken along plane 19—19 or FIG. 18.
Figure 20:
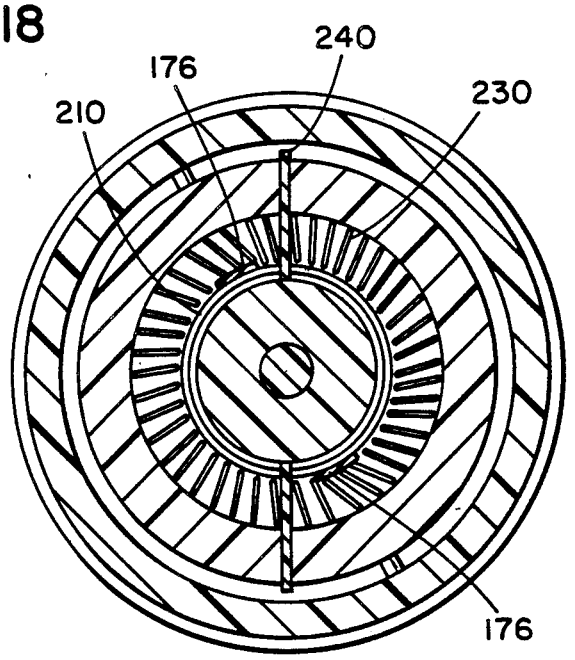
FIG. 20 is a sectional view taken along plane 19—19 of FIG. 18 but with elements of the plug assembly slightly rotated.

As seen in FIGS. 16, 19 and 20, the terminals of the socket assembly are preferably curved an amount consistent with the curve of the socket connector terminals 210 to improve the contact therebetween.

Figure 18:
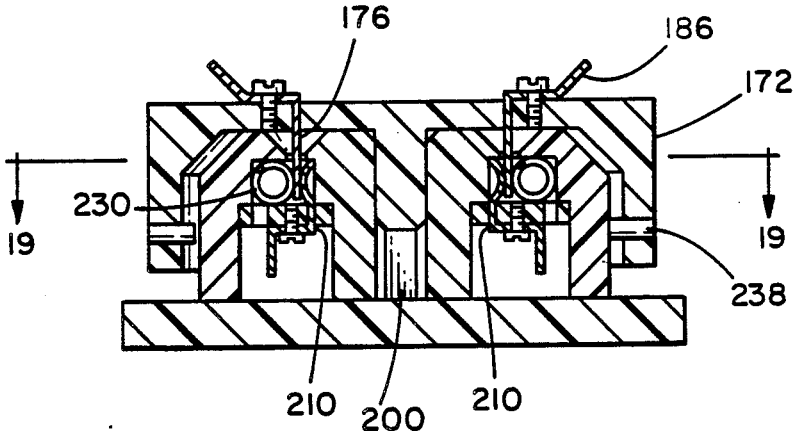
FIG. 18 is a sectional view similar to FIG. 14 but with the plug and socket assemblies in operative relationship one with respect to the other.

Internaly extending radial protuberances 238 are provided internal of the plug assembly wall aligned with the plug prongs. These are aligned with vertical insulating vanes 240 in the socket assembly. The vanes separate the exterior wall 196, coil springs 230 and conductive strip terminals 210 of the socket assembly into their two electrically isolated segments. The alignment of the protuberances and vanes is such as to preclude the prongs of the plug assembly from spanning the space from one socket assembly strip to another, an operative position. Except for this limitation, the plug may be provided on the socket in virtually any rotational orientation so long as the two assemblies are axially aligned Note is also taken that the upper edge of the socket assembly is provided with a bevel 244 on each upper face of each wall. The lower portion of the downwardly projecting post within the plug assembly is likewise provided with a bevel 246. These bevels are to insure proper axial locating of the plug assembly with respect to the socket assembly by a user to make their joining more convenient. Downward movement of the plug assembly with respect to the socket assembly is limited to the lower face 245 of the socket assembly wall 172 bottoming on the upper face 248 of the base, or by plug interior surface 142 engaging the top of wall 198 and/or the top of wall 196, as shown in FIG. 18.

The electrical contacts of each assembly are separated by an electrical insulator, post 188 and internal cylindrical wall 198 in the second embodiment. The function of these electrically insulating elements is to preclude an extraneous straight line conductor from simultaneously contacting both conductors and causing an inadvertent short circuit. Tube 96 and socket block 116 serve this function in the first embodiment.

As can be understood, the electrical conductors, prongs and terminals of both embodiments must be of a material with electrically conducting properties, such as copper, for proper functioning. And as can also be understood, their supporting or contacting structures, such as the various blocks and the upper face, washer and interior side wall of the second embodiment, are of a material with electrically insulating characteristics. The members with relatively moveable bearing surfaces, however, must be of a material with self-lubricating characteristics to preclude binding with attendant problems of operability. It is preferred that the plug and socket fit snugly, and that the downward depending sidewall of the plug reside in close proximity to or in engagement with the the upstanding sidewall of the socket. Such bearing members include the plug block of the first embodiment along with the washer and upper plate and the lower face of the tube along with the socket block with its recessed portion and slot, socket sidewall 108 and plug sidewall 30. In the second embodiment only the post and central aperture and the plug and socket sidewalls need be of a self-lubricating material. Polypropylene has been found to be a suitable material for the self-lubricating characteristics as well as for the electrically insulating characteristics.

As in the case of the first embodiment, a switch 200 can be provided through which socket terminals 210 are connected to a power supply. Post 188 is inserted into aperture 202 and plug wall 172 surrounds socket wall 196, to shield the socket terminals from inadvertent contact. When the plug assembly is fully engaged with the socket assembly, post 188 depresses button 201 on switch 200, energizing terminals 210. When the plug assembly is disengaged from the socket assembly, switch 200 is open and terminals 210 are disconnected from the power supply, reducing a shock hazard. Post 188 and switch 200 are so located that switch 200 is closed to energize terminals 210 only after the plug assembly shields access to terminals 210.

The present disclosure includes that information contained in the appended claims as well as that in the foregoing description. Although the invention has been described in its preferred forms or embodiments with a certain degree of particularity, it is understood that the present disclosure of the preferred form has been made only by way of example and that numerous changes in the details of construction, fabrication and use, including the combination and arrangement of parts and steps, may be resorted to without departing from the spirit and scope of the invention.

What is claimed is:

1. An electrical connector system comprising:

a plug assembly having a pair of electrical plug terminal means each spaced an equal distance from the axis of said plug assembly;

a socket assembly having a pair of electrical socket terminal means each spaced an equal distance from the axis of said socket assembly, said plug terminal means and said socket terminal means being engagable one with respect to the other to form an electrical connection therebetween when said plug assembly and said socket assembly are joined in axial alignment, virtually independent of the rotational position therebetween;

a coil spring to urge said plug terminal means and said socket terminal means towards each other to insure a secure electrical contact therebetween when the assemblies are joined; and shielding means on one of said socket assembly and said plug assembly to prevent access to said plug terminal means and said socket terminal means when said plug assembly and said socket assembly are joined in axial alignment.

2. The connector system as set forth in claim 1 wherein said socket terminal means are recessed within said socket assembly and said plug terminal means are recessed within said plug assembly with the distance of recess for the plug terminal means being greater than the distance of recess for the socket terminal means.

3. The connector system as set forth in claim 1 wherein said plug terminal means are separated by insulating means and said socket terminal means are separated by insulating means.

4. The connector system as set forth in claim 1 wherein said plug assembly includes radially inwardly projecting protuberances in a predetermined orientation with respect to said plug terminal means and said socket assembly includes radially outwardly projecting vanes in a predetermined orientation with respect to said socket terminal means so as to preclude the joining of said assemblies in an inoperative orientation.

5. The connector system as set forth in claim 1 wherein a switch is provided which connects said socket terminal means to power supply means when said plug assembly and said socket assembly are engaged and which disconnects said socket terminal means from said power supply means when said plug assembly and said socket assembly are disengaged.

6. The connector system as set forth in claim 4 wherein said coil spring is positioned within said plug assembly with its axis on the axis of said plug assembly.

7. The connector system as set forth in claim 6 wherein said coil spring has its opposite free ends secured to elements of said plug assembly whereby torsional forces of said coil spring will resiliently urge said plug terminal means toward said socket terminal means.

8. The connector system as set forth in claim 4 wherein said coil spring is positioned within said socket assembly with its axis formed in a circle and with the center of said circle located on the axis of said socket assembly.

9. The connector system as set forth in claim 8 wherein said coil spring has its exterior surface positioned adjacent said socket terminal means whereby forces of said coil spring will resiliently urge said plug terminal means toward said socket terminal means.

10. An electrical connector system comprising a plug assembly and a socket assembly:

(a) said plug assembly including:
  (1) a side wall and upper plate forming a cavity having an axis;
  (2) an electrically insulating plug block depending from said plate, rotatable about said axis;
  (3) a pair of electrically conductive prongs secured to said plug block and depending therefrom for rotation therewith;
  (4) a coil spring coaxial with said axis, said coil spring having its one end secured to said plate and its other end secured to said plug block to bias said plug block and prongs in a first rotational direction; and
  (5) a post extending downwardly from said plug block;

(b) said socket assembly including:
  (1) a base plate with an upstanding side wall and a cover face having an aperture therein and an axis through said aperture;
  (2) an electrically insulating cylindrical socket block axially slidable and rotatable between said base plate and said cover face along said axis;
  (3) a pair of electrically conductive prongs secured to said socket block in upstanding relationship for sliding and rotation therewith;
  (4) a coil spring having its axis aligned with said axis, for urging said socket block away from said base plate; and
  (5) rotation imparting means to rotate said socket block in a second rotational direction, opposite from said first rotational direction, upon axial movement of said socket block whereby upon the axial joining of said plug assembly with said socket assembly said post will depress said socket block and rotation it to thereby rotate said prongs on said socket block into contact with said prongs on said plug block.

11. The electrical connector system as set forth in claim 10 wherein said motion imparting means includes a rigid strip upstanding from said base plate coiled about said axis and a slot in said socket block for receiving said strip whereby axial movement of said socket block along said axis will rotate said socket block.

12. The electrical connector system as set forth in claim 10 wherein said plug assembly cavity is adapted to receive said socket assembly such that said plug assembly sidewall shields said electrically conductive prongs when said plug assembly is axially joined with said socket assembly.

13. The electrical connector system as set forth in claim 10 and further including radially inwardly projecting protuberances on said side wall of said plug assembly in radial alignment with said prongs of said plug block and radially outwardly projecting vanes on said side wall of said socket assembly in radial alignment with said prongs of said socket block so as to preclude the joining of said assemblies with said plug prongs aligned with said socket prongs.

14. The electrical connector system as set forth in claim 10 and further including an abutment pin depending from said upper plate and an abutment arm extending radially from said plug block whereby contact between said abutment pin and said abutment arm will limit the rotational movement of said plug block in said first rotational direction.

15. The electrical connector system as set forth in claim 10 wherein said plug prongs are recessed within said plug assembly a distance greater than the distance said socket prongs are recessed within said socket assembly.

16. An electrical connector system comprising a cylindrial plug assembly and a socket assembly:

(a) said plug assembly including:
  (1) a side wall with an upper face, forming a cavity having an axis,
  (2) a pair of electrically conductive prongs secured to said upper face in depending relationship therewith; and
  (3) a post depending from said upper face;

(b) said socket assembly including:
  (1) a base plate with an upstanding exterior side wall and an upstanding interior side wall, said side walls being concentric about an axis common with said socket assembly and defining an annular aperture therebetween;
  (2) a pair of electrically conductive strips secured to said interior side wall and extending into said aperture; and
  (3) coil spring means secured to said exterior side wall with its axis generally conforming to said aperture, with an exterior surface adjacent said conductive strips whereby, when said plug assembly is axially joined with said socket assembly, said plug prongs will be spring biased toward said conductive strips.

17. The electrical connector system as set forth in claim 16 and further including two insulating vanes extending radially through said exterior side wall to divide said conductive strips and said spring means each into two electrically separate segments essentially of semicircular configuration.

18. The electrical connector system as set forth in claim 17 and further including two protuberences extending inwardly from said side wall of said plug assembly and radially aligned with said plug prongs, said protuberences and said vanes being oriented to preclude said plug prongs from spanning the two segments of said conductive strips.

19. The electrical connector system as set forth in claim 16 wherein the said conductive strips are bowed radially outwardly with their centerlines extending into said aperture.

20. The electrical connector system as set forth in claim 16 wherein said conductive strips are connectible to a power supply through a switch which is engaged by said post when said plug assembly is joined with said socket assembly.

* * * * *